US008226309B2

(12) United States Patent
Funatsu

(10) Patent No.: US 8,226,309 B2
(45) Date of Patent: Jul. 24, 2012

(54) PRINTING APPARATUS

(75) Inventor: Kenichi Funatsu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 727 days.

(21) Appl. No.: 11/468,411

(22) Filed: Aug. 30, 2006

(65) Prior Publication Data

US 2007/0065219 A1 Mar. 22, 2007

(30) Foreign Application Priority Data

Sep. 22, 2005 (JP) ..... 2005-275888

(51) Int. Cl.

| | |
|---|---|
| ***B41J 11/58*** | (2006.01) |
| ***B41J 13/10*** | (2006.01) |
| ***B65H 3/06*** | (2006.01) |
| ***B65H 1/08*** | (2006.01) |
| ***B65H 1/18*** | (2006.01) |
| ***G03G 15/00*** | (2006.01) |

(52) U.S. Cl. ..... 400/624; 400/625; 271/117; 271/126; 271/152; 271/153; 271/162; 399/389

(58) Field of Classification Search ..... 271/162, 271/126–127, 147, 152–153, 117–118; 399/393, 399/23, 589; 400/629, 587, 624, 625
See application file for complete search history.

(56) References Cited

U.S. PATENT DOCUMENTS

| | | | | |
|---|---|---|---|---|
| 5,123,637 | A * | 6/1992 | Musaka | 271/117 |
| 5,642,145 | A * | 6/1997 | Tanaka et al. | 347/111 |
| 6,145,826 | A * | 11/2000 | Kawata | 270/58.28 |
| 6,267,522 | B1 * | 7/2001 | Slippy et al. | 400/708.1 |
| 7,444,112 | B2 * | 10/2008 | Murakami et al. | 399/392 |
| 2004/0240916 | A1 * | 12/2004 | Takata et al. | 399/367 |

FOREIGN PATENT DOCUMENTS

| | | | |
|---|---|---|---|
| JP | 59166972 | A | 9/1984 |
| JP | 5213453 | A | 8/1993 |
| JP | 6171786 | A | 6/1994 |
| JP | 6271119 | A | 9/1994 |
| JP | 09-263336 | A | 10/1997 |

(Continued)

OTHER PUBLICATIONS

Japanese Office Action for the related Japanese Application No. 2005-275888 mailed Oct. 6, 2009.

(Continued)

*Primary Examiner* — Daniel J Colilla
*Assistant Examiner* — Marissa Ferguson Samreth
(74) *Attorney, Agent, or Firm* — Panitch Schwarze Belisario & Nadel LLP

(57) ABSTRACT

A printing apparatus according to this invention contains a moving unit for moving a feed unit or a recording medium stacked on a stacking unit in a direction to separate them from one another or in a direction to render one in contact with the other based on a result of comparison between information, relating to the recording medium, included in image information and information, relating to the recording medium, input with an information input unit. With such the printing apparatus, a user can replace the recording medium stacked on the stacking unit in a short time without waiting for a feed unit or a recording medium to be moved, even where the information input with the information input unit differs from the information included in the image information.

13 Claims, 10 Drawing Sheets

FOREIGN PATENT DOCUMENTS

| | | | | |
|---|---|---|---|---|
| JP | 11189344 | A | | 7/1999 |
| JP | 11198461 | A | | 7/1999 |
| JP | 2001063850 | A | | 3/2001 |
| JP | 2001139155 | | * | 5/2001 |
| JP | 2001142670 | A | | 5/2001 |
| JP | 2001301991 | A | | 10/2001 |
| JP | 2001-322324 | | * | 11/2001 |
| JP | 2003192158 | A | | 7/2003 |
| JP | 2004191895 | | * | 7/2004 |
| JP | 2004-259219 | | * | 9/2004 |
| JP | 2005212966 | A | | 8/2005 |

OTHER PUBLICATIONS

Japanese Office Action for the related Japanese Application No. 2005-275888 mailed Mar. 9, 2010.

* cited by examiner

PRINTING APPARATUS

BACKGROUND OF THE INVENTION

1. Field of the Invention

This invention relates to a printing apparatus having a feed mechanism.

2. Description of Related Art

Conventionally, a printing apparatus such as, e.g., an electrophotographic printer, a photocopier, and a facsimile machine, having a feed mechanism for feeding paper stacked on a paper feed tray formed outside into an interior of the printing apparatus generally employs a paper feed method to rotate a paper feed roller to feed the paper into the interior thereof as the paper stacked on the paper feed tray is pushed upward and pressed against the paper feed roller together with a paper feed stage on the paper feed tray using a motor and the like. The printing apparatus keeps the paper pressed against the paper feed roller even where printing operation is not performed, so that the paper can be fed successively to improve throughput. Keeping the paper pressed against the paper feed roller enables the printing apparatus to perform feed operation concurrently with commencement of printing operation. A printing apparatus having such a feed mechanism is described in Japanese Patent Publication No. Hei 9-263336.

With such a printing apparatus, it is necessary for a user to replace paper stacked on the paper feed tray, where a paper size transmitted together with image information from an information processing apparatus differs from an actual size of the paper stacked on the paper feed tray. In order to replace the paper, however, the user needs to remove the paper from the paper feed stage, and then the printing apparatus needs to detect non-existence of the paper on the paper feed stage, which is subsequently moved downward based on the detected result, since the paper on the paper feed tray and the paper feed stage are held in a manner to press the paper against the paper feed roller at that time.

However, there raises a problem that such the paper feed method takes a prolonged time to replace the paper because a timing of commencement of downward moving operation of the paper feed stage is after the printing apparatus detects non-existence of the paper on the paper feed stage after the user removes the paper on the paper feed stage.

This invention is made in consideration of the above described problem, and it is an object of this invention to provide a printing apparatus capable of replacing paper stacked on a paper feed tray easily and swiftly, even where a paper size transmitted together with image information from the an information processing apparatus differs from an actual size of the paper stacked on the paper feed tray.

SUMMARY OF THE INVENTION

A printing apparatus according to this invention contains a printing unit for printing on a recording medium an image based on image information, input from outside, including information relating to a recording medium, a stacking unit for stacking a prescribed recording medium, an information input unit for inputting information relating to the recording medium stacked on the stacking unit, a feed unit for feeding a contacted recording medium to the printing unit by contacting the recording medium stacked on the stacking unit, and a moving unit for moving the feed unit or the recording medium stacked on the stacking unit in a direction to separate them from one another or in a direction to render one in contact the other based on a result of comparison between the information, relating to the recording medium, included in the image information and the information, relating to the recording medium, input with the information input unit.

With the above described structure, the moving unit moves the feed unit or the recording medium stacked on the stacking unit in a direction to separate them from one another or in a direction to render one in contact the other upon comparing the information, relating to the recording medium stacked on the stacking unit, which the user inputs with the information input unit and the information, relating to the recording medium, input from outside in a manner included in the image information.

Therefore, one can replace the paper in a shorter time, since the printing apparatus does not need to wait until the paper set on the feed unit is removed in order to perform operation to move the feed unit or the recording medium to change the distance therebetween.

BRIEF DESCRIPTION OF THE DRAWINGS

This invention may take physical form in certain parts and arrangements of parts, a preferred embodiment and method of which is described in detail in this specification and illustrated in the accompanying figures which form a part hereof, and wherein.

DETAILED DESCRIPTION OF PREFERRED EMBODIMENTS OF THE INVENTION

Hereinafter, particular embodiments according to this invention is described in detail with reference to the figures.

A printing apparatus according to the first embodiment of this invention compares paper type information as well as paper size information, input by a user, relating to paper stacked on a manual paper feed tray and paper type information as well as paper size information included in image information transmitted from a host apparatus such as, e.g., an information processing apparatus. Subsequently, a paper feed stage is driven based on the comparison result. Thus, the printing apparatus advances the timing to drive the paper feed stage, thus shortening the time to replace paper.

First, each member constituting a printing apparatus 1 is described in detail.

Figure 1:
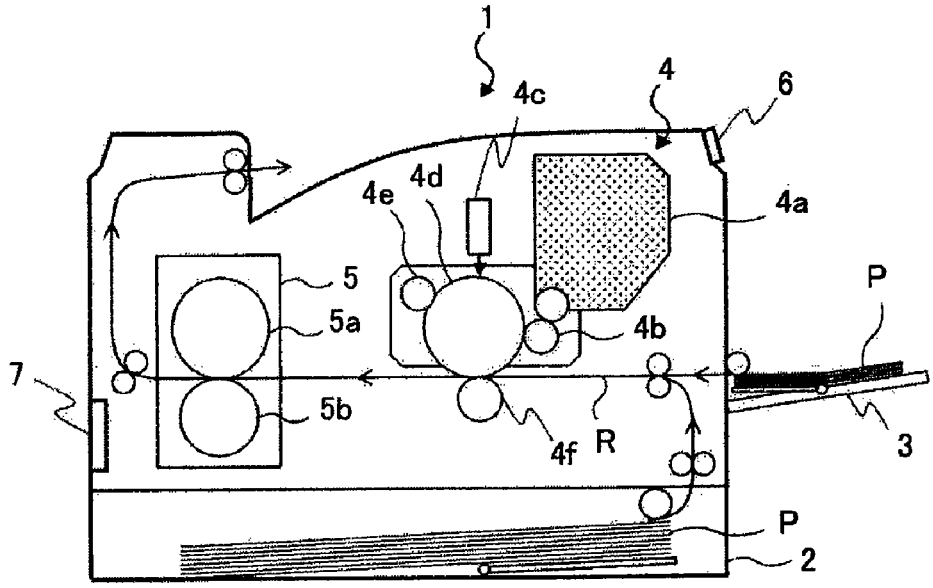
FIG. 1 is a cross-sectional view of an essential portion of a printing apparatus according to the first embodiment of this invention for illustrating a structure thereof.

As shown in FIG. 1, the printing apparatus 1 is composed of a paper tray 2 for stacking and accommodating paper P for providing the paper P to the printing apparatus 1 where performing printing, a paper supply 3 for stacking the paper P to provide the printing apparatus 1 with the paper P where performing manual paper feed printing, a developer unit 4 for developing a developer image based on image information on an image holding body as a latent image and transferring the developed latent image having a developer attached thereto onto a surface of the paper P according to a prescribed process, a fusing unit 5 for fusing onto the paper P the developer image transferred onto the surface of the paper P at the developer unit 4, an operator panel 6 for displaying prescribed information relating to the printing apparatus 1 to the user, and an interface connector 7 for connecting a cable for electrically connecting the information processing apparatus, not shown, and the printing apparatus 1.

The paper tray 2 is, for example, a member on which the user previously stacks and accommodates the paper P of a certain size, and the paper supply 3 is a member on which the user stacks the paper P to provide the paper P to the printing unit 1 where manual paper feed printing is performed. Upon transmission of the image information from the information processing apparatus, not shown, the paper P stacked on either the paper tray 2 or the paper supply 3 is conveyed to the developer unit 4 along a paper conveyance route R based on an instruction included in the image information or an instruction given by the user via the operator panel 6.

Figure 2A:
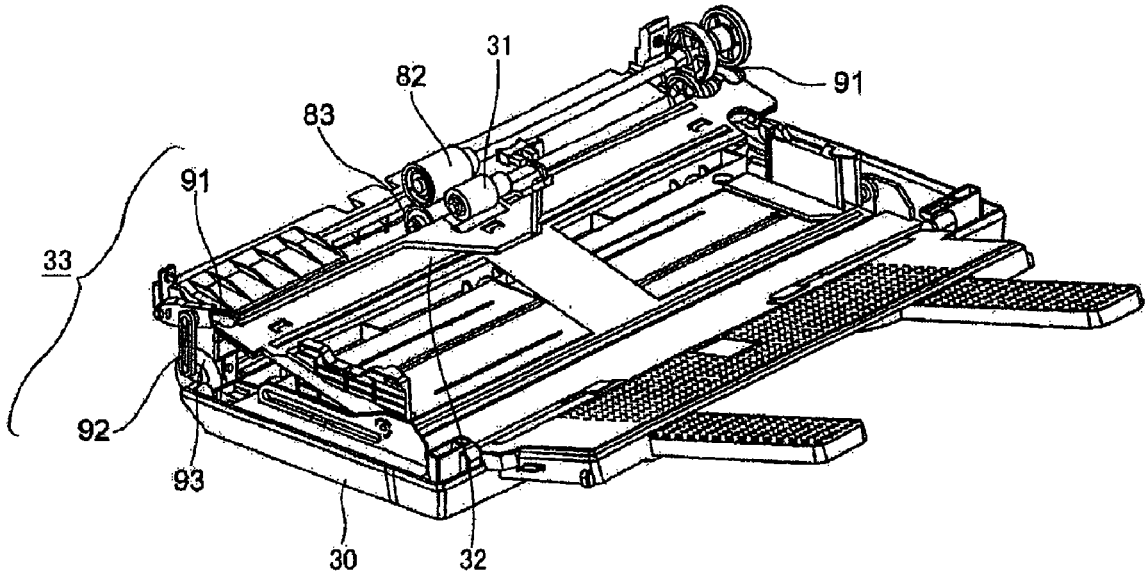
FIG. 2*a* is a perspective view of a paper supply of the printing apparatus for illustrating a structure thereof.
Figure 2B:
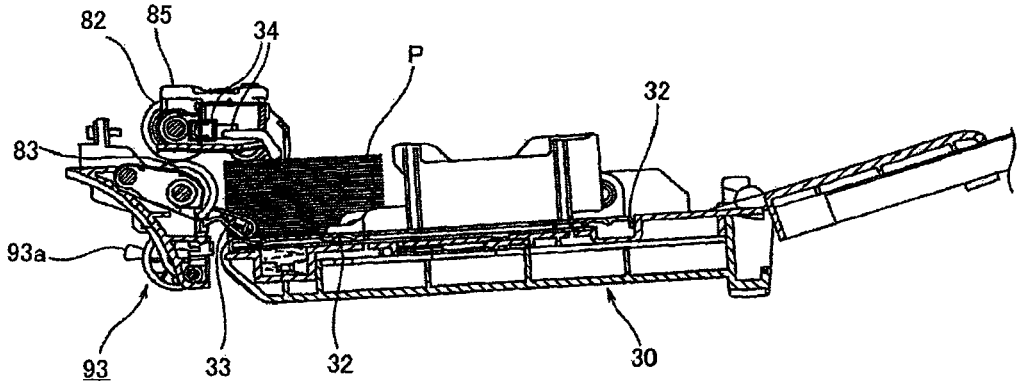
FIG. 2*b* is an elevation view of the paper supply of the printing apparatus, where paper is stacked on a paper feed tray.

The paper supply 3 is a member formed on a side wall of the printing apparatus 1 and, as shown in FIGS. 2*a* and 2*b*, is composed of a paper feed tray 30 in a tabular form for stacking the paper P, a paper feed roller 31 serving as a feed unit for feeding the paper P set on the paper feed tray 30 into an interior of the printing apparatus 1, a paper feed stage 32 for pushing up the paper P in a manner rendering the paper P in contact with the paper feed roller 31, a lifting arm 33 for moving the paper feed stage 32 up and down, a paper position detection sensor 34 for detecting a position of the paper P, and a paper sensor 35 for detecting whether the paper P exists on the paper feed tray 30.

The paper feed roller 31 is formed above an end portion of the paper feed stage 32 with a prescribed clearance from the paper feed stage 32. The paper feed roller 31 is a roller rotating about an axis parallel to a direction of a horizontal width of a side wall of the printing apparatus 1 on which the paper supply 3 is formed. The paper feed roller 31 rotates to feed the paper P into the interior of the printing apparatus 1, where the paper feed stage 32 is positioned at an upper side by a method as described below, and where the paper position detection sensor 34 detects the paper P stacked on the paper feed tray 30. The paper feed roller 31 is mechanically connected with a motor 31*a* as described below, and the paper feed roller 31 is rotated by driving force provided by the motor 31*a*.

A feed roller 82 for feeding the paper P fed with the paper feed roller 31 into the interior of the printing apparatus 1 and a retard roller 83 for singulating the paper P fed with the feed roller 82 are arranged on a downstream side of the paper feed roller 31 in a conveyance direction of a the paper P into the interior of the printing apparatus 1. The paper feed roller 31, the feed roller 82, and the paper position detection sensor 34 are formed unitedly on a flame 85 supported on a side of the printing apparatus 1.

One end of the paper feed stage 32 is pivotally supported on an upper surface of a near middle portion of the paper feed tray 30. When the user sets the paper on the paper supply 3, the paper P lies across from the paper feed stage 32 to the paper feed tray 30. As described below, a spring 32*a* is arranged between a lower surface of a portion near the other end of the paper feed stage 32 and the paper feed tray 30, and urges upward the paper feed stage 32. The lifting arm 33 is moved pivotally about an axis Sh4 to move pivotally a protruding portion formed on an outer surface of the lifting arm 33, and contacts the position near the other end of the paper feed stage 32. Furthermore, the lifting arm 33 is linked with a link gear 93 via a link member 92. The link gear 93 is mechanically connected to a motor 33*a* as described below, and the link gear 93 rotates about a prescribed axis driven by the motor 33*a*. The link member 92 is a stick shaped member for transmitting rotation force of the link gear 93 to the lifting arm 33. One end of the link member 92 is rotatably supported by the lifting arm 33, while the other end thereof is rotatably supported at a position offset from a rotation axis of the link gear 93. Where the lifting arm 33 is driven, the motor 33*a* is driven, so that the link gear 93 is rotated. Where the link gear 93 rotates, the other end of the link member 92 moves about the axis of the link gear 93 in a manner synchronized with rotation of the link gear 93. Since one end of the link member 92 moves upward where the other end thereof moves, the lifting arm 33 also rotates about the axis Sh4 in a manner synchronized with this movement.

The lifting arm 33, provided with the driving force by the motor 33*a*, causes the protruding portion formed thereon to press downward and hold the paper feed stage 32 by rotation of the lifting arm 33. Where moved pivotally by the motor 33*a* to position the protruding portion at an upper side, the lifting arm 33 is positioned at an upper side according to urging force from the spring 32*a* together with the paper feed stage 32 in contact with an upper surface of the paper feed stage 32.

Figure 2C:
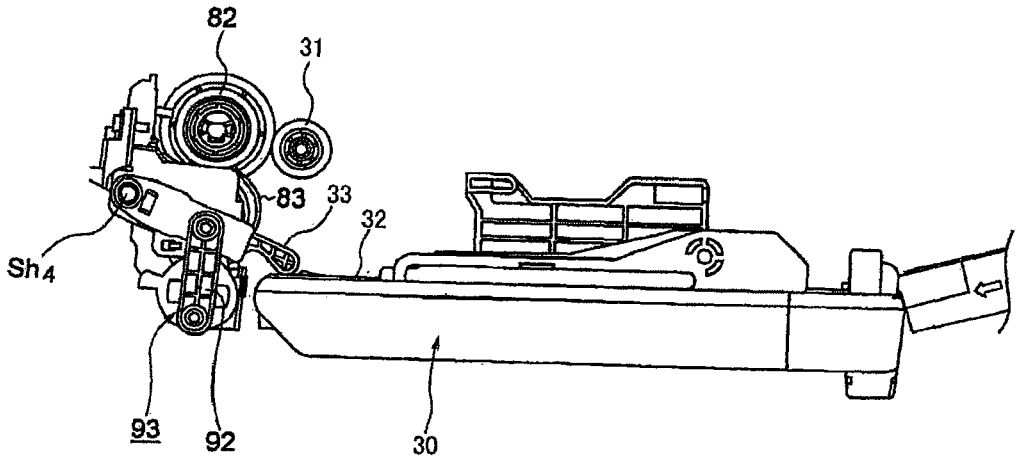
FIG. 2*c* is a cross-sectional view of an essential portion of the paper supply of the printing apparatus, where a paper feed stage is positioned at a lower side.
Figure 2D:
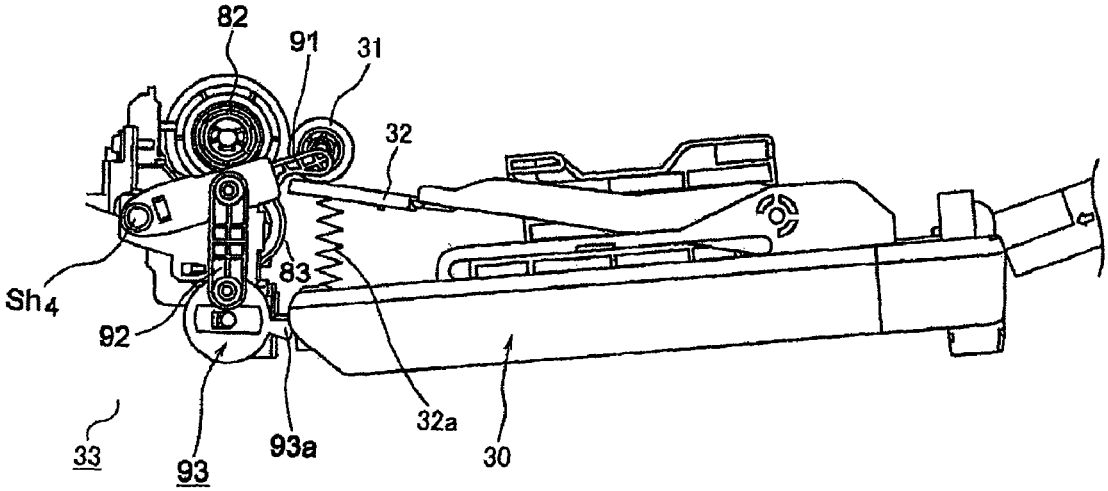
FIG. 2*d* is a cross-sectional view of an essential portion of the paper supply of the printing apparatus, where a paper feed stage is positioned at an upper side.

Regarding specific operation, the motor 33*a* moves pivotally the lifting arm 33 to render the protruding portion thereof downward, and thereby the other end portion of the paper feed stage 32 is moved downward as shown in FIG. 2*c*. On the other hand, the motor 33*a* moves pivotally the lifting arm 33 to render the protruding portion thereof upward, and thereby the urging force of the spring member 32*a* moves upward the other end portion of the paper feed stage 32 as shown in FIG. 2*d*. Where the paper feed stage 32 is positioned at a lower side, the paper P can be added or removed since there is a wide clearance between the paper feed stage 32 and the paper feed roller 31. Where the paper feed stage 32 is positioned at an upper side, the paper P set on the paper feed stage 32 contacts the paper feed roller 31, and is fed into the interior of the printing apparatus 1 by rotation of the paper feed roller 31.

The paper position detection sensor 34 is a sensor to detect whether the paper P exists at a position from which the paper P can be fed into the interior of the printing apparatus 1. More specifically, the paper position detection sensor 34 detects that the paper P exists at a position from which the paper P can be fed into the interior of the printing apparatus, where the paper feed stage 32 is positioned at an upper side, and where the paper P is set on the paper feed stage 30. On the other hand, the paper position detection sensor 34 detects that the paper P does not exist at a position from which the paper P can be fed into the interior of the printing apparatus 1, where the paper feed stage 32 is positioned at a lower side, or where the paper P does not exist on the paper feed stage 32 though the paper feed stage is positioned at an upper side.

The paper sensor 35 is a sensor to detect whether the paper P is set on the paper feed tray 30. Specifically, the paper detection sensor 35 detects whether the paper P is set on the paper feed tray 30 where the paper feed stage 32 is positioned at a lower side. The paper feed stage 32 is not moved upward where the printing apparatus 1 detects that paper P is not set on the paper feed tray 30.

The developer unit 4 develops and transfers the developer image based on the image information transmitted via the interface connector 7 onto the surface of the paper P conveyed along the paper conveyance route R. The developer unit 4 is composed of a developer cartridge 4*a* for accommodating the developer, a feed roller 4*b* for providing the developer to a photosensitive drum 4*d*, an exposure unit 4*c* for exposing the latent image based on the image information on a surface of the photosensitive drum 4*d*, the photosensitive drum 4*d* on a surface of which latent images are formed based on the image information, and a charging roller 4*e* for applying a bias voltage to the photosensitive drum 4*d*. A transfer roller 4*f* is formed at a position opposing to the photosensitive drum 4*d*, and a power source, not shown, applies the bias voltage to the transfer roller 4*f*. With such the printing apparatus, when the paper P is conveyed to a position from which the paper P can be conveyed in a manner nipped between the photosensitive drum 4*d* and the transfer roller 4*f*, the developer is transferred onto the surface of the paper P using a potential difference of bias voltages between the photosensitive drum 4*d* and the transfer roller 4*f*, and thus the developer image based on the image information is printed on the surface of the paper P.

In the developer unit 4, the paper P having the developer image on the surface thereof is further conveyed to the fuser unit 5 along the paper conveyance route R. The fuser unit 5 melts, using heat, the developer transferred onto the surface of the paper P to fuse the developer on the surface of the paper P. The fuser unit 5 is composed of a fuser roller 5*a* having a prescribed heat source in the interior thereof, and a conveyance roller 5*b* capable of conveying the paper P in a manner that the conveyance roller 5*b* and the fuser roller 5*a* nip the paper P. The fuser unit 5 conveys the paper P in a manner that the paper P is nipped between the fuser roller 5*a* heated by the prescribed heat source and the conveyance roller 5*b* pressured by the fuser roller 5*a*, so that the fuser unit 5 fuses the developer image on the surface of the paper P. The paper P having the developer image fused, at the fuser unit 5, on the surface thereof is discharged to a stacker formed on an upper surface of the printing unit 1 upon conveyed along the paper conveyance route R, and thus the paper P is provided to the user.

Subsequently, a control system for controlling each of the above mentioned members is described in detail below.

Figure 3:
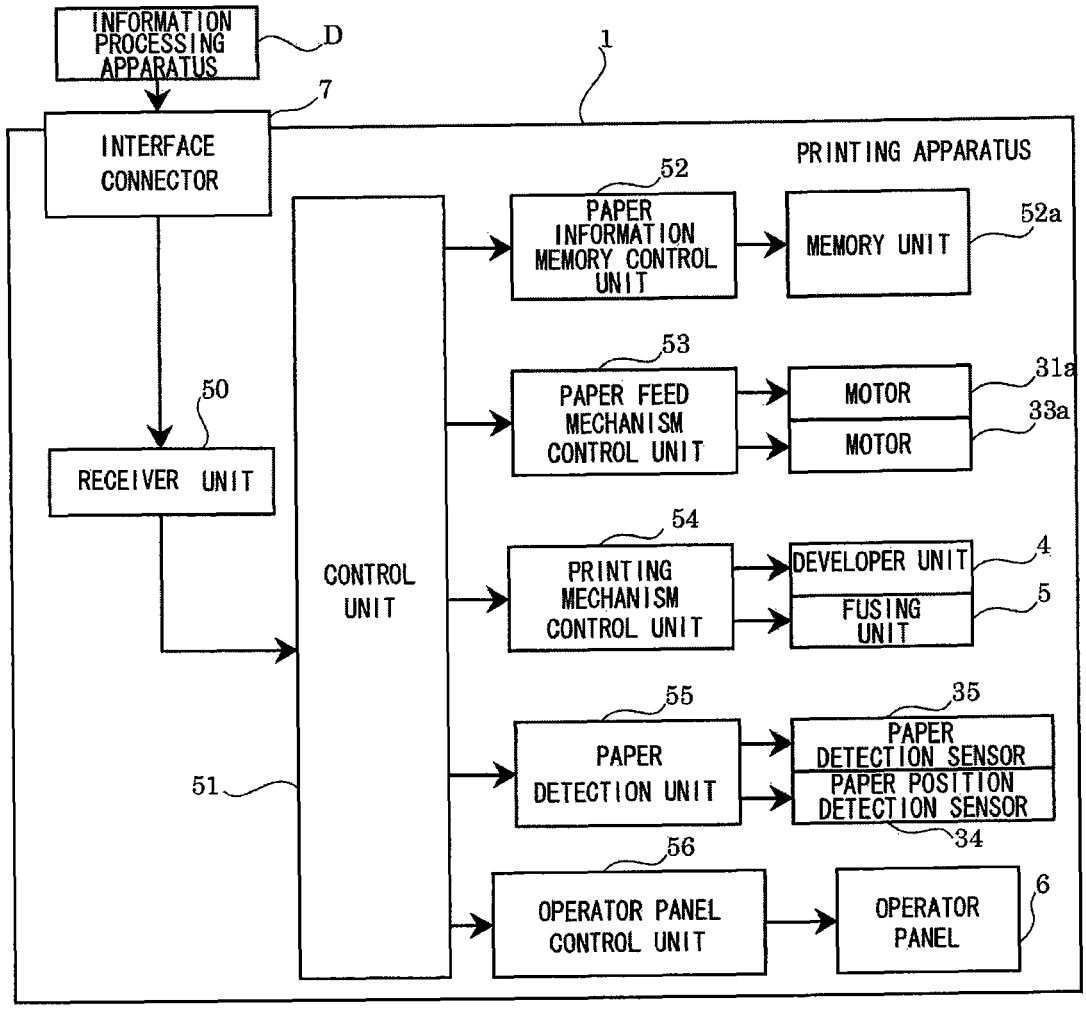
FIG. 3 is a block diagram showing a configuration of the printing apparatus for illustrating the configuration thereof.

The printing apparatus 1, as shown in FIG. 3, is composed of a receiver unit 50 for receiving image information transmitted from the information processing apparatus D via the interface connector 7, a control unit 51 composed of, i.e., a CPU (Central Processing Unit), a paper information memory control unit 52 for performing control for storing information relating to the paper, a paper feed mechanism control unit 53 for controlling a paper feed mechanism, a printing mechanism control unit 54 for controlling, e.g., the developer unit 4 and the fuser unit 5, a paper detection unit 55 for detecting the paper P set on the paper feed tray 30, and an operator panel control unit 56 for controlling the operator panel 6. The printing apparatus 1 having a structure described above receives at the receiver unit 50 the image information transmitted from the information processing apparatus D via the interface connector 7, and the receiver unit 50 provides the control unit 51 with notification of a reception of the image information upon receiving the image information. The control unit 51 to which the notification is provided provides a prescribed instruction to the paper information memory control unit 52, the paper feed mechanism control unit 53, the printing mechanism control unit 54, the paper detection unit 55, and the operator panel control unit 56, and thus the image based on the image information is printed on the paper P. It is be assumed that the image information transmitted from the information processing apparatus D includes information relating to a paper size and information relating to a paper type.

The paper information memory control unit 52 is connected to a memory unit 52*a* composed of a nonvolatile memory such as, e.g., EEPROM. This memory unit 52*a* is a member to store information which relates to the paper P and which is input with the operator panel 6, and writes the information to the memory unit 52*a* based on an instruction from the control unit 51. The paper feed mechanism control unit 53 controls operation of each member where the printing apparatus 1 feed the paper P into the interior thereof based on an instruction from the control unit 51. Specifically the paper feed mechanism control unit 53 controls a drive of a motor 31*a* and a motor 33*a*. The printing mechanism control unit 54 controls operation of each member where the printing apparatus 1 prints the developer image on the paper P based on an instruction from the control unit 51. Specifically, the printing mechanism control unit 54 controls the developer unit 4 and the fuser unit 5. The paper detection unit 55 controls the paper position detection sensor 34 and the paper sensor 35 based on an instruction from the control unit 51. The operator panel control unit 56 displays the prescribed information on the operator panel 6 based on an instruction from the control unit 51, and notifies to the control unit 51 information which the user inputs with the operator panel 6.

Hereinafter, operation of the printing apparatus 1 having the above described structure is described in detail.

Figure 4:
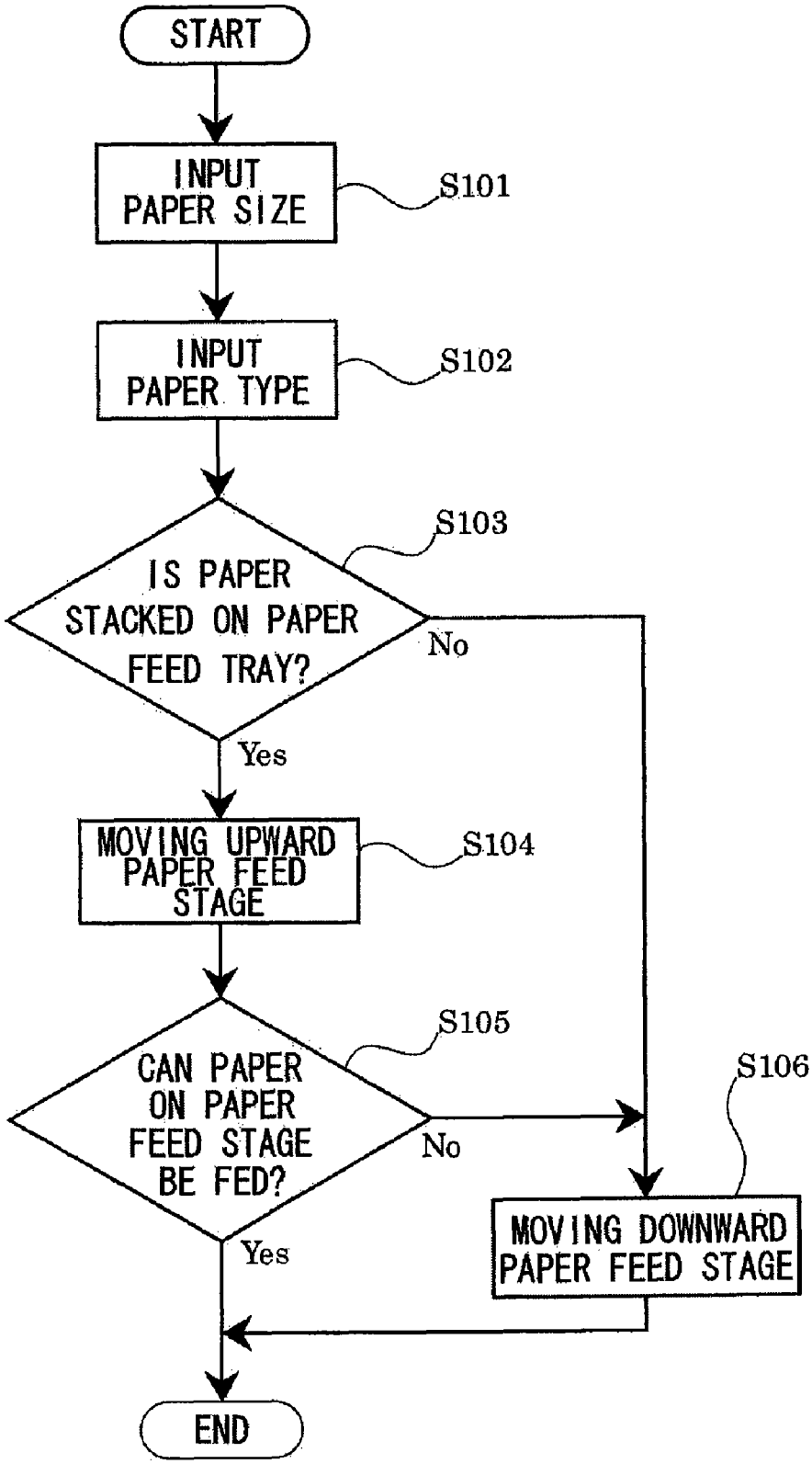
FIG. 4 is a flow chart showing operation of the printing apparatus for illustrating the operation thereof, where paper is being set on the paper supply.

First, operation. of the printing apparatus 1 where the paper P is set on the paper supply 3 is described with reference to FIG. 4. At that time, the paper feed stage 32 is assumed to be positioned at a lower side.

A step S101 is a process in which the user inputs information relating to a size of paper P. Specifically, the user inputs information relating to a size of paper which the user desires to use via the operator panel 6. The information input here is provided to the control unit 51 via the operator panel control unit 56, and then the control unit 51 provides the paper information memory control unit 52 with an instruction to store the information in the memory unit 52*a*. The paper information memory control unit 52, upon being provided with the instruction, writes to the memory unit 52*a* the information relating to the paper size which is input with the operator panel 6. Subsequently, the printing apparatus 1 executes the process of step S102.

A step S102 is a process in which the user inputs information relating to a type of paper P. Specifically, the user inputs information relating to a type of paper which the user desires to use via the operator panel 6. The information input here is provided to the control unit 51 via the operator panel control unit 56, and then the control unit 51 provides the paper information memory control unit 52 with an instruction to store the information in the memory unit 52*a*. The paper information memory control unit 52, upon being provided with the instruction, writes to the memory unit 52*a* the information which relates to the paper type and which is input with the operator panel 6. It is to be noted that the information stored at the steps S101 and S102 in the memory unit 52*a* composed of a nonvolatile memory such as, e.g., EEPROM will not disappear even where, for example, the printing apparatus 1 is powered off. Subsequently, the printing apparatus 1 executes the process of step S103 in order to detect whether the paper P is set on the paper feed tray 30.

The step S103 is a process to detect whether paper is set on the paper feed tray 30. Specifically, the control unit 51 provides the paper detection unit 55 with an instruction to detect whether paper exists on the paper feed tray 30. The paper detection unit 55, upon being provided with the instruction, detects whether the paper P is set on the paper feed tray 30 using the paper sensor 35, and provides the detected result to the control unit 51. Where the printing apparatus 1 detects that the paper P is set on the paper feed tray 30, the printing apparatus 1 executes the process of step S104 so that the paper P set on the paper feed tray 30 can be fed into the interior of the printing apparatus 1. Where the printing apparatus 1 detects that the paper P is not set on the paper feed tray 30, the printing apparatus 1 executes the process of step S106 so that the user can set the paper P on the paper feed tray 30.

The step S104 is one of the processes to enable the paper P set on the paper feed tray 30 to be fed into the interior of the printing apparatus 1 by moving upward the paper feed stage 32. Specifically, the control unit 51 provides the paper feed mechanism control unit 53 with an instruction to drive the motor 33*a* to rotate the lifting arm 33. The paper feed mechanism control unit 53, upon being provided with the instruction, drives the motor 33*a* to move upward the protruding portion of the lifting arm 33. At that time, the printing apparatus 1 moves upward the paper feed stage 32 until the paper position detection sensor 34 detects that paper is set on the paper feed stage 32. Subsequently, the printing apparatus 1 executes the process of step S105.

The step S105 is the other process to enable the paper P set on the paper feed tray 30 to be fed into the interior of the printing apparatus 1. Specifically, the step S105 detects whether the paper P set on the paper feed tray 30 rendered at an upper position at the step S104 is located at a position from which the paper P can be fed, using the feed roller 31, into the interior of the printing apparatus 1. In this case, the control unit 51 provides the paper detection unit 55 with an instruction to detect whether the paper P set on the paper feed tray 30 is located at a position from which the paper P can be fed into the interior of the printing apparatus 1. The paper detection unit 55, upon being provided with the instruction, causes the paper position detection sensor 34 to detect whether the paper P set on the paper feed tray 30 is located at a position from which the paper P can be fed into the interior of the printing apparatus 1, and provides the detected result to the control unit 51. Where the printing apparatus 1 detects that the paper P set on the paper feed tray 30 is located at a position from which the paper P can be fed into the interior of the printing apparatus 1, this series of processes is terminated. Where the printing apparatus 1 detects that the paper P set on the paper feed tray 30 is not located at a position from which the paper P can be fed into the interior of the printing apparatus 1, the process of step S106 is executed so that the user can set the paper P on the paper feed tray 30.

The step S106 is a process to enable the user to add or remove the paper P on the paper feed tray 30 by moving downward the paper feed stage 32. Specifically, the control unit 51 provides the paper feed mechanism control unit 53 with an instruction to drive the motor 33*a* to rotate the lifting arm 33. The paper feed mechanism control unit 53, upon provided with the instruction, moves downward the protruding portion of the lifting arm 33 upon driving the motor 33*a* to move downward the paper feed stage 32, and subsequently this series of processes is terminated.

Hereinabove described is operation of the printing apparatus 1 where the paper P is set on the paper supply 3.

Figure 5:
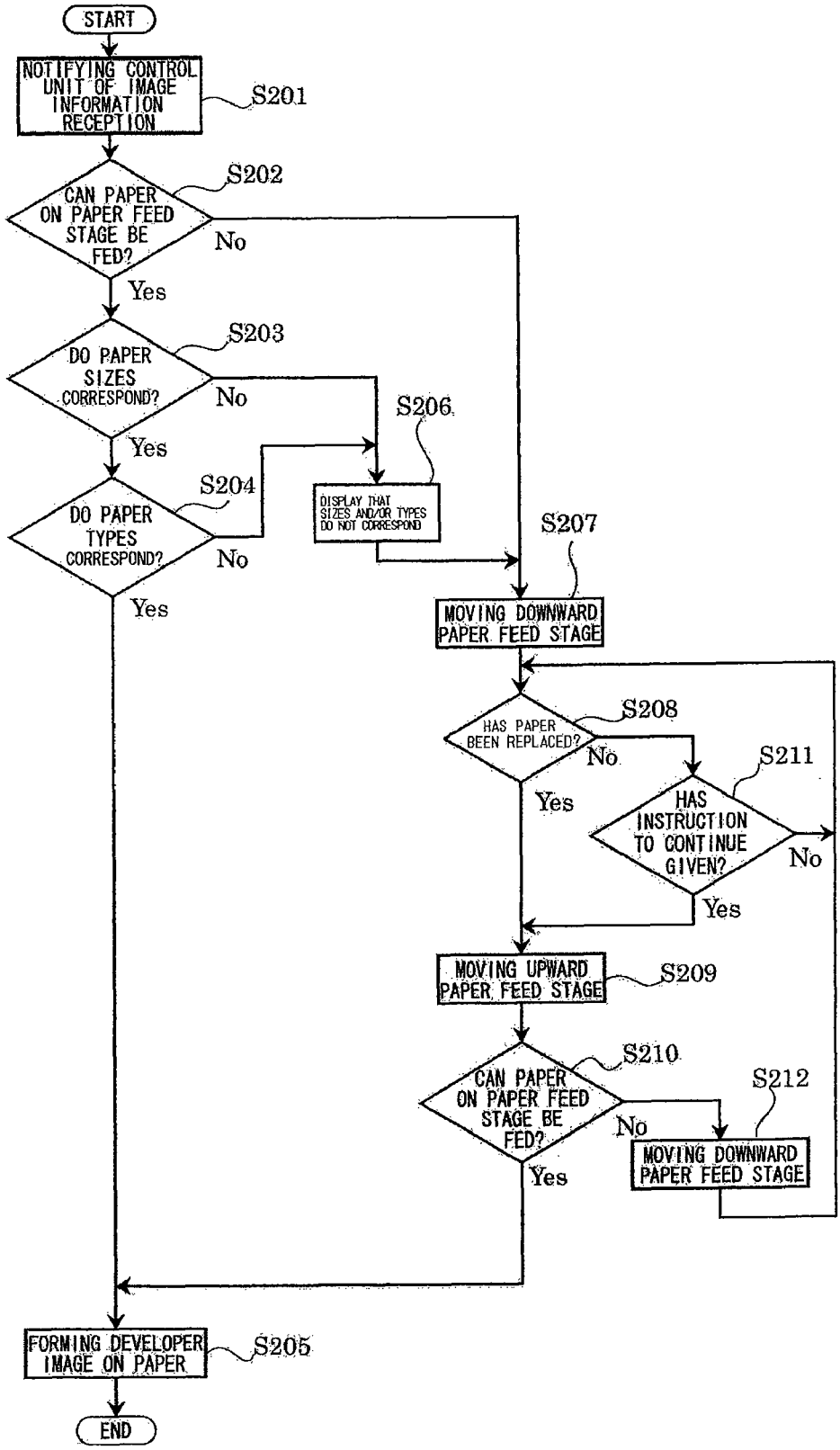
FIG. 5 is a flow chart showing operation of the printing apparatus for illustrating the operation thereof, where a developer image is printed on paper.

Subsequently, operation of the printing apparatus 1 where the developer image based on image information is printed on the paper P is described with reference to FIG. 5. At that time, the paper feed stage 32 is assumed to be located at an upper position.

The step S201 is a process in which the receiver unit 50 provides the control unit 51 with notification that image information is received from the information processing apparatus. The receiver unit 50 provides the control unit 51 with the notification that the image information is received and with the received image information. Subsequently, the printing apparatus 1 executes the process of step 202.

The step S202 is a process in which the control unit 51 detects whether the paper P is located at a position from which the paper P can be fed after the control unit 51 is provided with the notification that the image information is received from the receiver unit 50 at the step S201. Specifically, the control unit 51 provides the paper detection unit 55 with an instruction to detect, using the paper position detection sensor 34, whether the paper P set on the feed tray 30 is located at a position from which the paper P can be fed. The paper detection unit 55, upon being provided with the instruction, detects, using the paper position detection sensor 34, whether the paper P stacked on the paper feed tray 30 is located at a position from which the paper P can be fed into the interior of the printing apparatus 1, and then the paper detection unit 55 provides the control unit 51 with the detected result. Where the printing apparatus 1 detects that the paper P is located at a position from which the paper P can be fed into the interior of the printing apparatus 1, the printing apparatus 1 executes the process of step S203 to compare the paper size. Where the printing apparatus 1 detects that the paper P is not located at a position from which the paper P can be fed into the interior of the printing apparatus 1, the printing apparatus 1 executes a process of S207 to enable the user to set the paper P on the paper feed tray 30.

The step S203 is a process to detect Whether the paper size information which the user inputs with the operator panel 6 corresponds to the paper size information transmitted in a manner included in the image information. Specifically, the control unit 51 provides the paper information memory control unit 52 with an instruction to read out the paper size information stored in the memory unit 52*a*. Upon being provided with the instruction, the paper information memory control unit 52 reads out the paper size information stored in the memory unit 52*a* in accordance with the instruction, and provides the information to the control unit 51. Subsequently, the control unit 51 compares the received paper size information and the paper size information transmitted in a manner included in the image information, and executes one of the following two processes based on the comparison result. Where the paper size information input with the operator panel 6 does not correspond to the paper size information transmitted in a manner included in the image information, the user is notified that the paper size information which the user inputs with the operator panel 6 does not correspond to the paper size information transmitted in a manner included in the image information. Where the paper size information input with the operator panel 6 corresponds to the paper size information transmitted in a manner included in the image information, the process of step S204 is executed to compare the paper type.

The step S204 is a process to detect whether the paper type information which the user inputs with the operator panel 6 corresponds to the paper type information transmitted in a manner included in the image information. Specifically, the control unit 51 provides the paper information memory control unit 52 with an instruction to read out the paper type information stored in the memory unit 52*a*. Upon being provided with the instruction, the paper information memory control unit 52 reads out the paper type information in accordance with the instruction, and provides the information to the control unit 51. Subsequently, the control unit 51 compares the received paper type information and the paper type information transmitted in a manner included in the image information, and executes one of the following two processes based on the comparison result. Where the paper type information input with the operator panel 6 does not correspond to the paper type information transmitted in a manner included in the image information, the user is notified that the paper type information which the user inputs with the operator panel 6 does not correspond to the paper type information transmitted in a manner included in the image information. Where the paper type information input with the operator panel 6 corresponds to the paper type information transmitted in a manner included in the image information, the process is proceeded to the step S205 to print on the paper P the developer image based on the image information. At the step S205, the control unit 51 provides the printing mechanism control unit 54 with the instruction to print on the paper P the developer image based on the image information, and this series of processes is terminated after printing the developer image on the paper P.

Where the paper size information which the user inputs with the operator panel 6 at the step S203 does not correspond to the paper size information transmitted in a manner included in the image information, or where the paper type information which the user inputs with the operator panel 6 at the step S204 does not correspond to the paper type information transmitted in a manner included in the image information, the control unit 51 provides, at the step S206, the operator panel control unit 56 with an instruction to display the prescribed information on the operator panel 6, and the process of step S207 is executed to enable the user to set the paper P on the paper feed tray 30. Information displayed on the operator panel 6 at the step S206 is the information that the paper size information which the user inputs with the operator panel 6 does not correspond to the paper size information transmitted in a manner included in the image information, or the information that the paper type information which the user inputs with the operator panel 6 does not correspond to the paper type information transmitted in a manner included in the image information. By notifying the user of the information via the operator panel 6, the user can prepare for replacing the paper P set on the paper feed tray 30.

The step S207 is a process to move downward the paper feed stage 32 so that the user can replace the paper P set on the paper feed tray 30. The step S207 is a process to be executed, where the control unit 51 detects, at the step S202, that the paper P is not located at the position from which the paper P can be fed into the interior of the printing apparatus 1, or after the prescribed information is displayed on the operator panel 6 at the step S206. Specifically, the control unit 51 provides the paper feed mechanism control unit 53 with an instruction to drive the motor 33*a*. The paper feed mechanism control unit 53, upon being provided with the instruction, provides driving force to the lifting arm 33 upon driving the motor 33*a* to move downward the paper feed stage 32. Subsequently, the printing apparatus 1 executes a process of the step S208 to detect whether the paper P set on the paper feed tray 30 is replaced.

The step S208 is a process to detect whether the paper P on the paper feed tray 30 is replaced. Specifically, the control unit 51 provides the paper detection unit 55 with the instruction to detect whether the paper P is replaced. The paper detection unit 55, upon being provided the instruction, detects whether the paper P is replaced using the paper sensor 35, and provides the control unit 51 with the detected result. Where it is detected that the paper is replaced, a process of the step S209 is executed so that the paper P set on the paper feed tray 30 can be fed into the interior of the printing apparatus 1. Where it is detected that the paper P is not replaced, a process of the step S211 is executed to determine whether this series of processes is to be continued.

The step S211 is a process arranged in consideration of an existence of a case that the user desires to continue this series of processes even where the paper sizes or the paper types do not correspond. Where the user gives an instruction via the operator panel 6 to continue this series of processes, a process of the step S209 is executed so that the paper P set on the paper feed tray 30 can be fed into the interior of the printing apparatus 1. Where no instruction is given by the user, a process of the step S208 is executed again, and such steps are repeated until the paper P is replaced or the job relating to the image information is canceled.

The step S209 is a process to move upward the paper feed stage 32 so that the paper P set on the paper feed tray 30 can be fed into the interior of the printing apparatus 1. The step S209 is a process to be executed, where the control unit 51 detects that the paper P is replaced at the step S208, or where the instruction to continue this series of processes is given via the operator panel 6 at the step S211. The printing apparatus 1 moves upward the paper feed stage 32 as described above. At that time, the printing apparatus 1 moves upward the paper feed stage 32 until the paper position detection sensor 34 detects that the paper P is set on the paper feed stage 32. Subsequently, the process of step S210 is executed to enable the paper P to be fed into the interior of the printing apparatus 1.

The step S210 is a process to detect whether the paper P is located at the position from which the paper P can be fed into the interior of the printing apparatus 1 in substantially the same manner as the step 202 to enable the paper P set on the paper feed tray 30 to be fed into the interior of the printing apparatus 1. Where the printing apparatus 1 detects that the paper P set on the paper feed tray 30 is located at the position from which the paper P can be fed into the interior of the printing apparatus 1, the process is proceeded to the step S205. At the step S205, the control unit 51 provides the printing mechanism control unit 54 with an instruction to print on the paper P the developer image based on the image information, and terminates this series of processes upon printing the developer image on the paper P. Where the printing apparatus 1 detects that the paper P is not located at the position from which the paper P can be fed into the interior of the printing apparatus 1, a process of the step S212 is executed to enable the user to set the paper P on the paper feed tray 30.

The step 212 is a process to move downward the paper feed stage 32, in substantially the same manner as the step 207, to enable the user to replace the paper P set on the paper feed tray 30. Subsequently, the printing apparatus 1 executes a process of the step S208 again to detect whether the paper set on the paper feed tray 30 is replaced.

As described above, the printing apparatus 1 compares the information relating to the paper P set on the paper feed tray 30 and the information transmitted from the information processing apparatus in a manner included in the image information, and then the printing apparatus 1, based on the comparison result, moves downward the paper feed stage 32 to demand the user to replace the paper P, or continues the printing process while holding the paper feed stage 32 at an upper position.

With such the printing apparatus 1, the paper feed stage 32 is moved downward concurrently with displaying the notification on the operator panel 6 that the paper size information does not correspond to the paper type information upon detecting that the paper size information does not correspond to the paper type information, so that the paper feed stage 32 can be moved downward while the user prepares for replacing the paper upon referring to the operator panel 6. Therefore, the paper feed stage 32 is already moved downward where the user tries to replace the paper upon finishing the preparation for replacing the paper, and thus the user can replace the paper in a short time without waiting for the paper feed stage 32 being moved downward.

Hereinafter, the second embodiment according to this invention is described in detail.

Since a printing apparatus 100 according to the second embodiment of this invention includes portions having an approximately same structure as the printing apparatus 1 according to the first embodiment, precise descriptions relating to the portions having an approximately same structure are omitted, and only a paper supply having a different structure is described in detail. Specifically, the printing apparatus 100 compares the paper type information input by the user as well as the paper size information, detected by the paper size sensor, relating to the paper stacked on the manual paper feed tray and the paper type information as well as the paper size information transmitted in a manner included in the image information from a host apparatus such as, e.g., the information processing apparatus. Subsequently, the paper feed stage is driven based on the comparison result. Thus, the timing to drive the paper feed stage is advanced, so that the paper can be replaced in a shorter time.

Figure 6A:
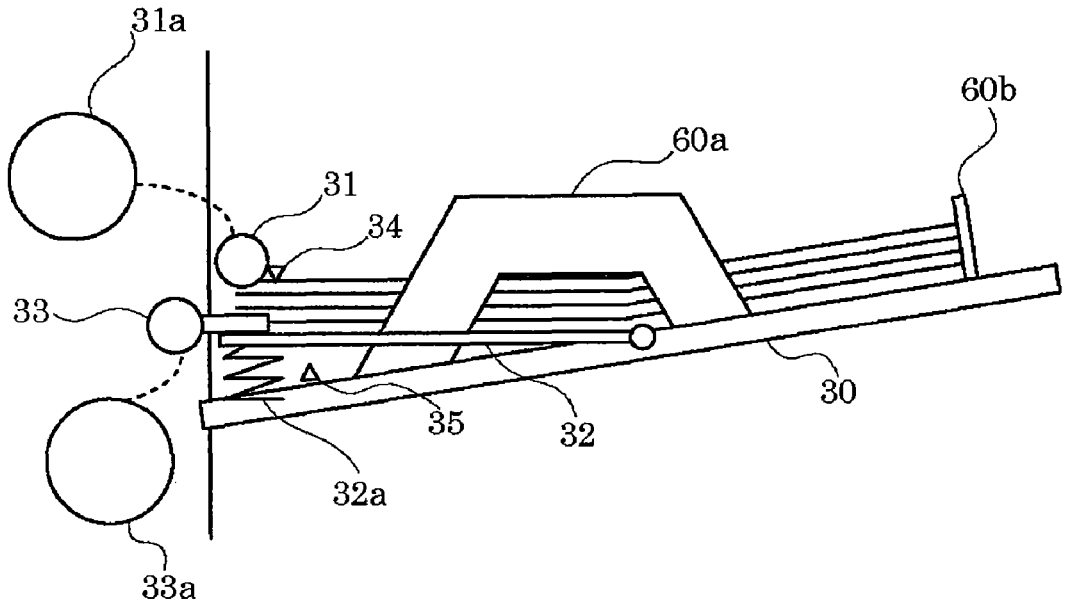
FIG. 6*a* is an elevation view of an essential portion of a paper supply of a printing apparatus according to the second embodiment of this invention for illustrating a structure thereof, where a paper feed stage is positioned at an upper side.
Figure 6B:
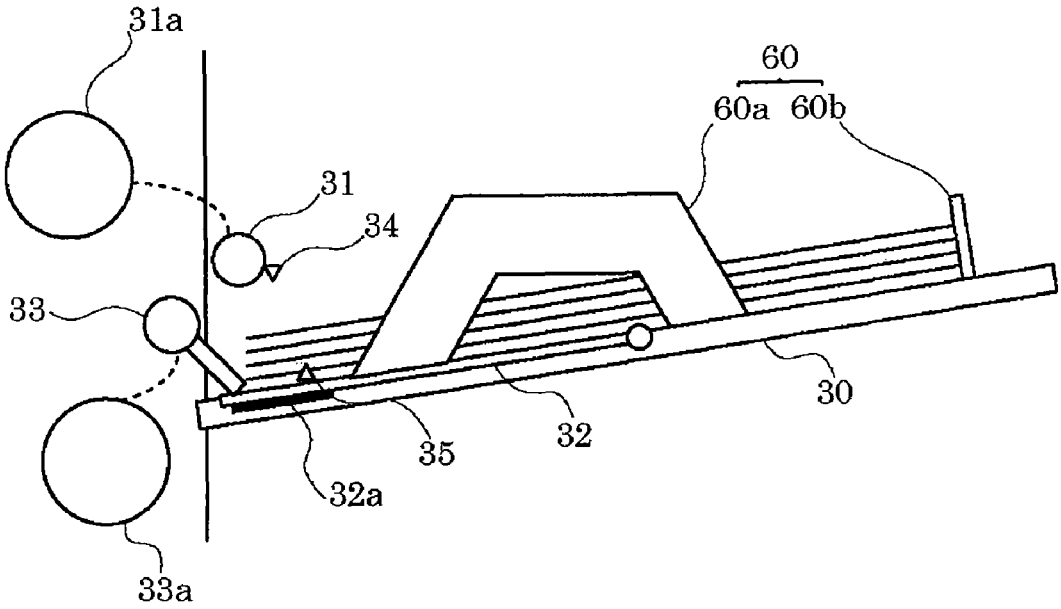
FIG. 6*b* is an elevation view showing an essential portion of the paper supply of the printing apparatus, where the paper feed stage is positioned at a lower side.

As shown in FIG. 6*a* and FIG. 6*b*, the paper supply 103 is composed of the paper feed tray 30, the paper feed roller 31, the motor 31*a*, the paper feed stage 32, the spring 32*a*, the lifting arm 33, the motor 33*a*, the paper position detection sensor 34, the paper sensor 35, and the paper size sensor 60 for detecting the paper size.

The paper size sensor 60 is a member formed with two members slidably arranged perpendicular relative to one another. Specifically, the paper size sensor 60 is composed of the paper width guide 60*a* formed slidably in a direction of the paper width on the paper feed tray 30 for detecting the width of the paper P, and the paper length guide 60*b* formed slidably in a direction of the paper length on the paper feed tray 30 for detecting the length of the paper P. The user stacks the paper P on the paper feed tray 30, and slides the paper width guide 60*a* and the paper length guide 60*b* so that the guides come in contact with the paper P set on the paper feed tray 30. Subsequently, where the paper width guide 60*a* and the paper length guide 60*b* are in contact with the paper P, the position of the paper width guide 60*a* and the paper length guide 60*b* are detected, so that the paper size is determined based on the detected position information.

Figure 7:
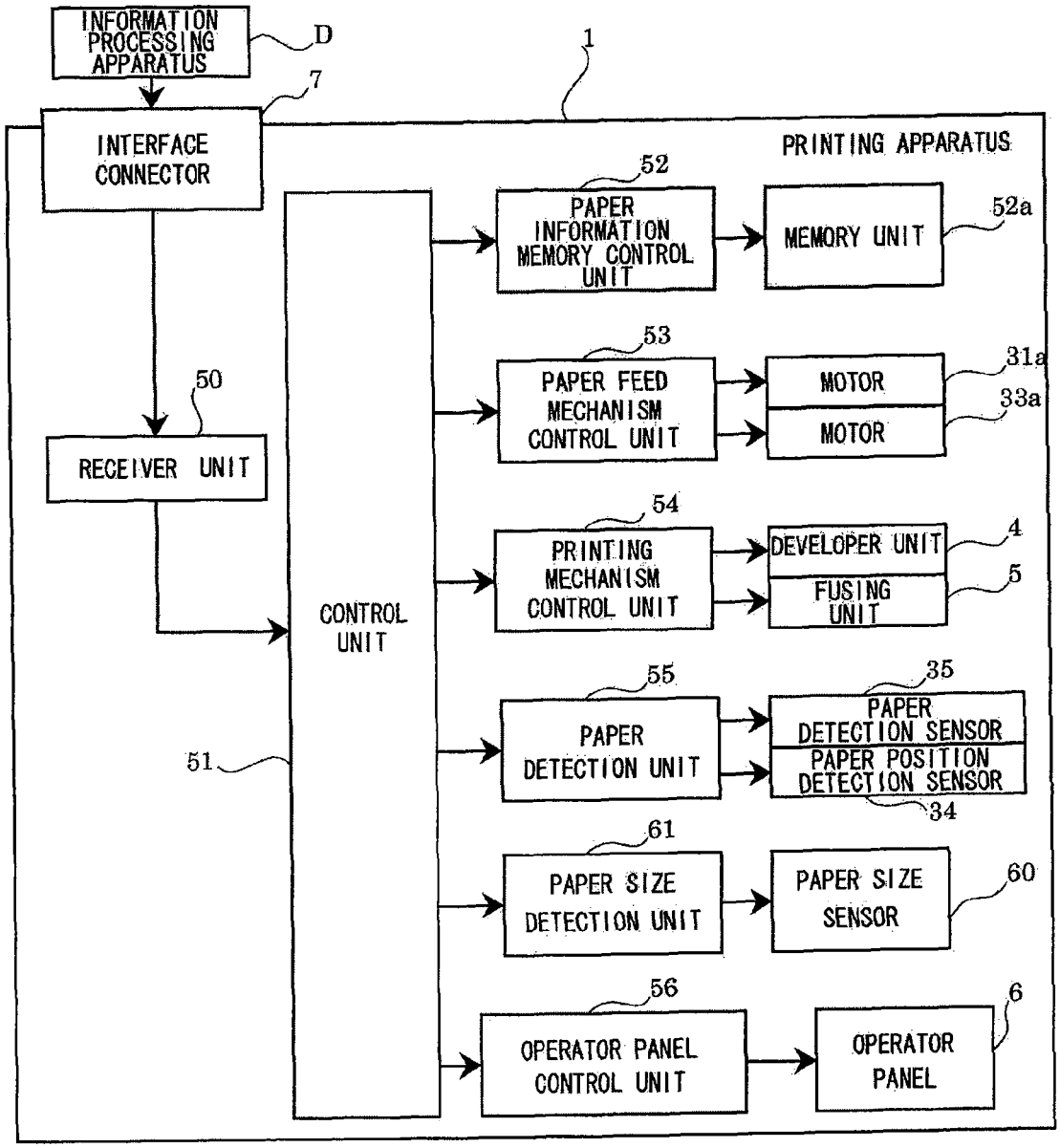
FIG. 7 is a block diagram showing a configuration of the printing apparatus for illustrating the configuration thereof.

As shown in FIG. 7, the printing apparatus 100 is composed of the receiver unit 50, the control unit 51, the paper information memory control unit 52, the paper feed mechanism control unit 53, the printing mechanism control unit 54, the paper detection unit 55, the operator panel control unit 56, and the paper size detection unit 61.

The paper size detection unit 61 not only detects the paper size set on the paper feed tray 30 using the paper size sensor 60 based on the instruction of the control unit 51 but also provides the control unit 51 with the detected result.

Hereinafter, operation of the printing apparatus 100 having the above mentioned structure is described in detail .

Figure 8:
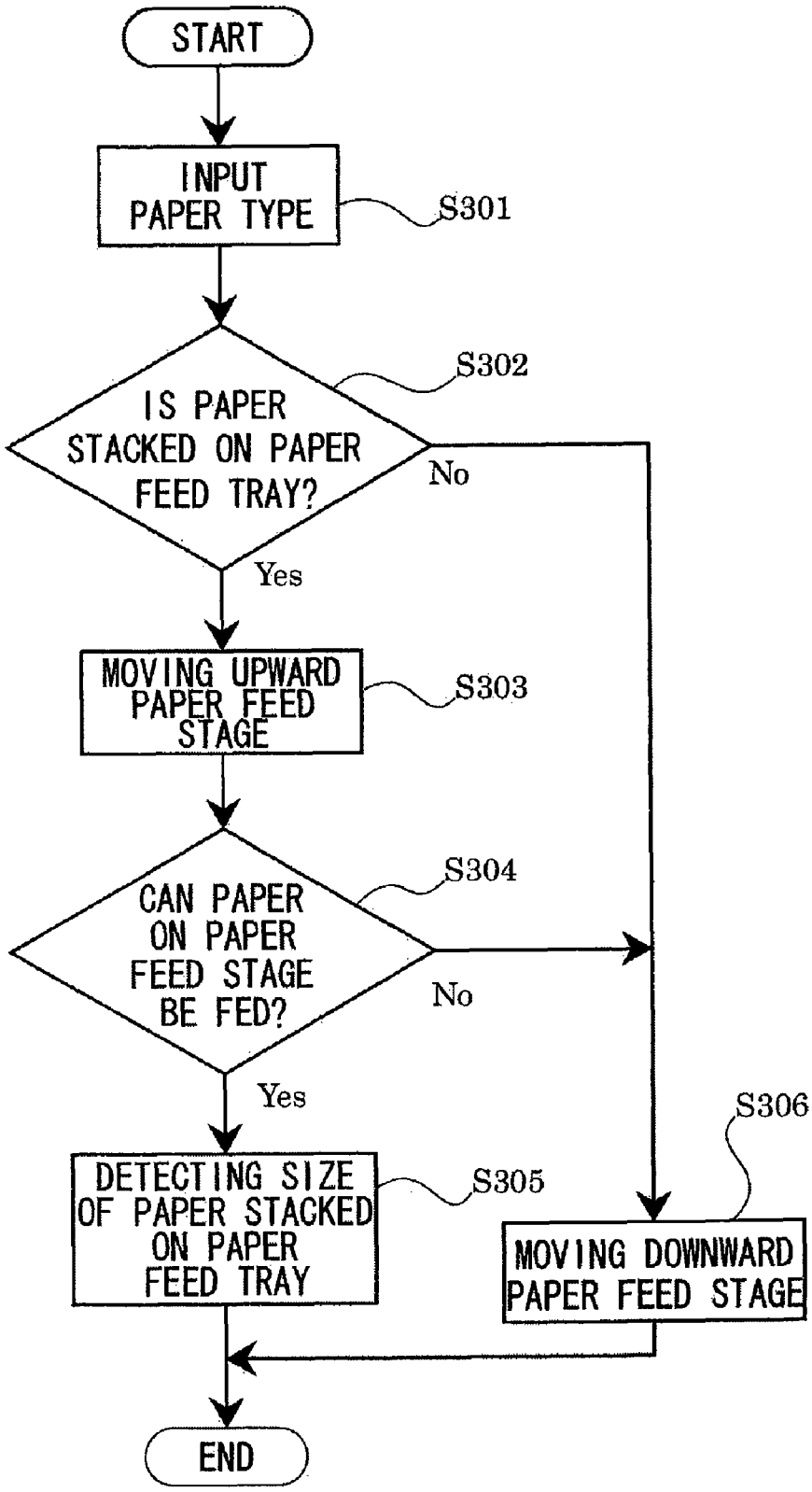
FIG. 8 is a flow chart showing operation of the printing apparatus for illustrating the operation thereof, where paper is being set on the paper supply.

First, operation of the printing apparatus 100 where the paper P is being set on the paper supply 3 is described with reference to FIG. 8. At that time, the paper feed stage 32 is assumed to be located at a lower position.

The step S301 is a process in which the user inputs the information relating to the type of the paper P. Specifically, the user sets on the paper feed tray 30 the paper which the user desires to use, and renders the paper guide sensor 60 in contact with the paper P. Furthermore, the user inputs the information relating to the type of the paper set on the paper feed tray 30 with the operator panel 6. The information input here is provided to the control unit 51 via the operator panel control unit 56. Subsequently, the control unit 51 provides the paper information control unit 52 with an instruction to store the information into the memory unit 52*a*, and the paper information memory control unit 52, upon being provided with the instruction, writes to the memory unit 52*a* the paper type information input with the operator panel 6. Subsequently, the printing apparatus 100 executes the process of step S302.

The step S302 is a process in which the printing apparatus 100 detects whether the paper is set on the paper feed tray 30. This process is substantially the same as the step S103 mentioned above. Where the printing apparatus 100 detects that the paper P is set on the paper feed tray 30, the process of step S303 is executed so that the paper P set on the paper feed tray 30 can be fed into the interior of the printing apparatus 100. Where the printing apparatus 100 detects that the paper P is not set on the paper feed tray 30, the printing apparatus 100 executes the process of step S306 so that the user can set the paper P on the paper feed tray 30.

The step S303 is one of the processes to enable the paper P set on the paper feed tray 30 to be fed into the interior of the printing apparatus 100 by moving upward the paper feed stage 32. This process is substantially the same as the step S104 mentioned above. The printing apparatus 100 moves upward the paper feed stage 32. At that time, the printing apparatus 100 moves upward the paper feed stage 32 until the paper position detection sensor 34 detects that the paper is set on the paper feed stage 32. Subsequently, the printing apparatus 100 executes the process of step S304.

The step S304 is the other process to enable the paper P set on the paper feed tray 30 to be fed into the interior of the printing apparatus 100. This process is substantially the same as the step S105 mentioned above. Where the printing apparatus 100 detects the paper P set on the paper feed tray 30 is located at a position from which the paper P can be fed into the interior of the printing apparatus 100, the printing apparatus 100 executes the process of step S305 to detect the paper size set on the paper feed tray 30. Where the printing apparatus 100 detects that the paper P set on the paper feed tray 30 is not located at a position from which the paper P can be fed into the interior of the printing apparatus 100, the process of step S306 is executed so that the user can set the paper P on the paper feed tray 30.

The step S305 is a process to detect the size of the paper P set on the paper feed tray 30. Specifically, the control unit 51 provides the paper size detection unit 61 with an instruction to detect the size of the paper P set on the paper feed tray 30 using the paper size sensor 60. The paper size detection unit 61, upon being provided with the instruction, detects the paper size based on the position information of the paper size sensor 60, and provides the control unit 51 with the detected result, and subsequently this series of processes is terminated.

The step S306 is a process to enable the user to add or remove the paper P on the paper feed tray 30 by moving downward the paper feed stage 32. This process is substantially the same as the step S106 mentioned above. The printing apparatus 100 moves downward the paper feed stage 32, and subsequently this series of processes is terminated.

With such a process, the paper P is set on the paper supply 3 of the printing apparatus 100.

Figure 9:
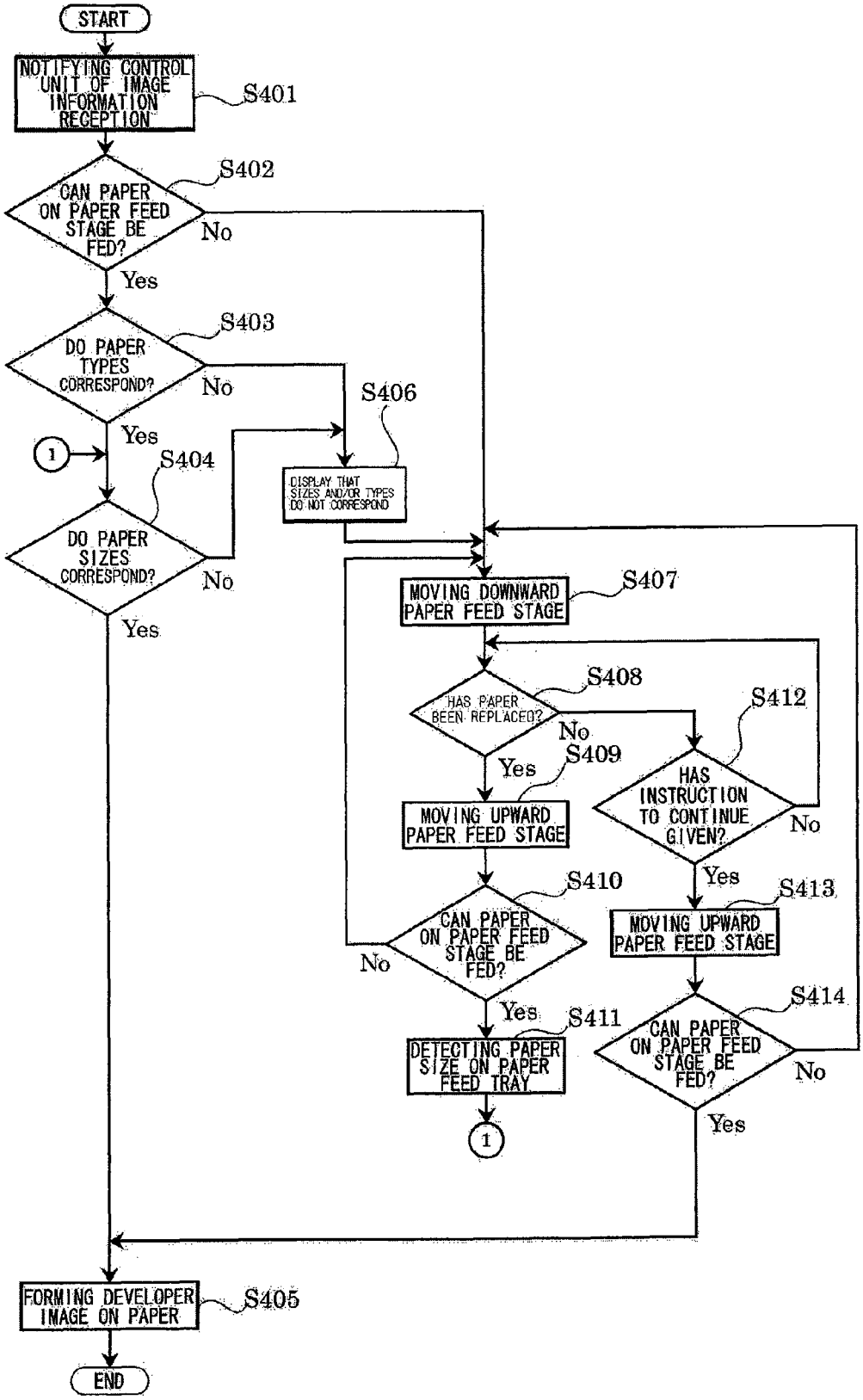
FIG. 9 is a flow chart showing operation of the printing apparatus for illustrating the operation thereof, where a developer image is printed on paper.

Subsequently, operation of the printing apparatus 100 where the developer image based on the image information is printed on the paper P is described with reference to FIG. 9. At that time, the paper feed stage 32 is assumed to be positioned at an upper side.

The step S401 is a process in which the receiver unit 50 provides the control unit 51 with notification that the image information is received from the information processing apparatus. This process is substantially the same as the step S201 mentioned above. The printing apparatus 100 executes the process of step S402 upon fnishing this process.

The step S402 is a process in which the control unit 51, upon being provided at the step S401 with the notification that the image information is received from the receiver unit 50, detects whether the paper P is located at a position from which the paper P can be fed. This process is substantially the same as the step S202 mentioned above. Where the printing apparatus 100 detects that the paper P is located at a position from which the paper P can be fed into the interior of the printing apparatus 100, the printing apparatus 100 executes the process of step S403 to compare the paper type. Where the printing apparatus 100 detects that the paper P is not located at a position from which the paper P can be fed into the interior of the printing apparatus 100, the printing apparatus 100 executes a process of S407 to enable the user to set the paper P on the paper feed tray 30.

The step S403 is a process to detect whether the paper type information input with the operator panel 6 corresponds to the paper type information transmitted in a manner included in the image information. This process is substantially the same as the step S204 mentioned above. Where the paper type information input with the operator panel 6 does not correspond to the paper type information transmitted in a manner included in the image information, the user is notified, at the process of step S406, that the paper type information input with the operator panel 6 not correspond to the paper type information transmitted in a manner included in the image information. Where the paper type information input with the operator panel 6 corresponds to the paper type information transmitted in a manner included in the image information, the process is proceeded to the step S404.

The step S404 is a process to determine whether the paper size information detected at the paper size detection unit 61 corresponds to the paper size information transmitted in a manner included in the image information. Specifically, the control unit 51 provides the paper information memory control unit 52 with the instruction to read out the paper size information stored in the memory unit 52*a*. The paper information memory control unit 52, upon being provided with the instruction, reads out the paper size information stored in the memory unit 52*a* based on the instruction, and provides the control unit 51 with the information. Subsequently, the control unit 51 compares the received paper size information and the paper size information transmitted in a manner included in the image information, and executes one of the two following process based on the comparison result. Where the paper size information detected at the paper size detection unit 61 does not correspond to the paper size information transmitted in a manner included in the image information, the user is notified thereof at the process of step S406. Where the paper size information detected at the paper size detection unit 61 corresponds to the paper size information transmitted in a manner included in the image information, the process is proceeded to the step S405. At the step S405, the control unit 51 provides the printing mechanism control unit 54 with the instruction to print on the paper P the developer image based on the image information, and this series of processes is terminated after printing the developer image on the paper P.

The step S406 is a process to be executed, where at the step S403 the paper type information input with the operator panel 6 does not correspond to the paper type information transmitted in a manner included in the image information, or where at the step S404 the paper size information detected by the paper size detection unit 61 does not correspond to the paper size information transmitted in a manner included in the image information. At the step S406, the control unit 51 provides the operator panel control unit 56 with an instruction to display the prescribed information on the operator panel 6. The prescribed information to be displayed thereon is the information that the paper size information detected by the paper size detection unit 61 does not correspond to the paper size information transmitted in a manner included in the image information, or the information that the paper type information input with the operator panel 6 does not correspond to the paper type information transmitted in a manner included in the image information. The information is notified to the user via the operator panel 6 so that the user can prepare for replacing the paper P set on the paper feed tray 30.

The step S407 is a process to move downward the paper feed stage 32 so that the user can replace the paper P set on the paper feed tray 30. This process is substantially the same as the step S207 mentioned above. The printing apparatus 100, upon moving downward the paper feed stage 32, executes the process of step S408 to detect whether the paper set on the paper feed tray 30 is replaced.

The step S408 is a process to detect whether the paper P on the paper feed tray 30 is replaced. This process is substantially the same as the step S408 mentioned above. Where it is detected that the paper is replaced, the printing apparatus 100 executes the process of step S409 so that the paper P set on the paper feed tray 30 can be fed into the interior of the printing apparatus 100. Where it is detected that the paper P is not replaced, the process of step S412 is executed to determine whether this series of processes is to be continued.

The step S412 is a process arranged in consideration of an existence of a case that the user desires to continue this series of processes even where the paper sizes and the paper types do not correspond. This process is substantially the same as the step S211. Where the user gives the instruction via the operator panel 6 to continue this series of processes, the process of step S409 is executed so that the paper P set on the paper feed tray 30 can be fed into the interior of the printing apparatus 100. Where no instruction is given by the user, the process of step S408 is executed again, and such steps are repeated until the paper P is replaced or the job relating to the image information is canceled.

The step S409 is a process to move upward the paper feed stage 32 so that the paper P set on the paper feed tray 30 can be fed into the interior of the printing apparatus 100. This process is substantially the same as the step S209 mentioned above. The printing apparatus 100 moves upward the paper feed stage 32. At that time, the printing apparatus 100 moves upward the paper feed stage 32 until the paper position detection sensor 34 detects that the paper is set on the paper feed stage 32. Subsequently, the printing apparatus 100 executes the process of step S410 to enable the paper P to be fed into the interior of the printing apparatus 100.

The step S410 is a process to enable the paper P set on the paper feed tray 30 to be fed into the interior of the printing apparatus 100 by detecting whether the paper P is located at the position from which the paper P can be fed into the interior of the printing apparatus 100. This process is substantially the same as the step S210 mentioned above. Where the printing apparatus 100 detects that the paper P set on the paper feed tray 30 is located at the position from which the paper P can be fed into the interior of the printing apparatus 100, the process is proceeded to the step S411 to detect the size of the paper P set on the paper feed tray 30. Where the printing apparatus 100 detects that the paper P is not located at the position from which the paper P can be fed into the interior of the printing apparatus 100, the process of step S407 is executed again.

The step S411 is a process to detect the size of the paper P set on the paper feed tray 30. This process is substantially the same as the step S305 mentioned above. The printing apparatus 100, upon detecting the size of the paper P set on the paper feed tray 30, executes the process of step S404 to compare the type of the paper P set on the paper feed tray 30.

The step S413 is a process to enable the paper P set on the paper feed tray 30 to be fed into the interior of the printing apparatus 100 by moving upward the paper feed stage 32. This process is substantially the same as the step S104 mentioned above. The printing apparatus 100 moves upward the paper feed stage 32. At that time, the printing apparatus 100 moves upward the paper feed stage 32 until the paper position detection sensor 34 detects that the paper is set on the paper feed stage 32. Subsequently, the printing apparatus 100 executes the process of step S414 to enable the paper P set on the paper feed tray 30 to be fed into the interior of the printing apparatus 100.

The step S414 is a process to detect whether the paper P is located at the position from which the paper P can be fed into the interior of the printing apparatus 100 to enable the paper P set on the paper feed tray 30 to be fed into the interior of the printing apparatus 100. This process is substantially the same as the step S210 mentioned above. Where the printing apparatus 100 detects that the paper P set on the paper feed tray 30 is located at the position from which the paper P can be fed into the interior of the printing apparatus 100, the printing apparatus 100 executes the step S405 to print on the paper P the developer image based on the image information. Where the printing apparatus 100 detects that the paper P is not located at the position from which the paper P can be fed into the interior of the printing apparatus 100, the printing apparatus 100 executes the process of step S407 again.

As hereinabove described, the printing apparatus 100 compares the information relating to the paper P set on the paper feed tray 30 and the information transmitted from the information processing apparatus in a manner included in the image information, and then the printing apparatus 100, based on the comparison result, either moves downward the paper feed stage 32 or continues the printing process.

The paper feed stage 32 is moved downward concurrently with the notification to the user on the operator panel 6 that the paper size information or the paper type information does not correspond upon detecting that the paper size information or the paper type information does not correspond, so that the paper feed stage 32 can be moved downward while the user prepares for replacing the paper upon referring to the operator panel 6. Therefore, the paper feed stage 32 is already moved downward at the time when the user is about to replace the paper upon finishing preparing for replacing the paper, and the user can replace the paper in a short time without waiting for the paper feed stage 32 being moved downward.

This invention is not limited to the above described embodiments. For example, although the manual paper feed tray is described in detail in the above embodiments, not only the manual paper feed tray but also one having a paper feed mechanism moved by drive power such as, e.g., a motor and having a mechanism in which paper is fed by contract of a paper feed roller against the paper set on a paper feed stage can be controlled in substantially the same way.

Furthermore, a mechanism of the paper supply 3 described in detail in the above embodiment is an example to which this invention is applied. Not only the paper supply 3 having the above described structure but also one having a paper feed mechanism for moving a paper feed stage by drive power such as, e.g., a motor and having a mechanism in which paper is fed by contract of a paper feed roller against paper set on a paper feed stage can also be controlled in substantially the same way as the paper supply 3 described above.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A printing apparatus comprising:

a stacking unit for stacking a recording medium;

a first information input unit for receiving image information from an information processing apparatus, the image information including image data and first information related to the recording medium on which the image data is to be printed;

a second information input unit for receiving second input information relating to the recording medium from a user of the printing apparatus;

a feed unit for feeding a contacted recording medium to a printing unit by contacting the recording medium stacked on the stacking unit;

a moving unit for moving the stacking unit: in a direction to separate the feed unit and the recording medium from one another, or in a direction to render one of the feed unit and the recording medium to contact the other of the feed unit and the recording medium;

a control unit for actuating the moving unit to move the stacking unit relative to the feed unit to a close position, if the recording medium is stacked on the stacking unit, and for actuating the moving unit to move the stacking unit relative to the feed unit to be further from one another, from the close position, if upon comparison of the first and the second information, the second information is deemed inconsistent with the first information;

a memory unit for storing the first information relating to the recording medium after the first information relating to the recording medium to be stacked on the stacking unit is set;

a notification unit for notifying that the first information does not correspond with the second information in a case where the first information and the second information are deemed inconsistent; and a medium replacement detection unit for detecting whether the recording medium on the stacking unit is replaced;

wherein the control unit lets the notification unit notify that the first information does not correspond with the second information and separates the feed unit from the medium in a case where the first information and the second information are deemed inconsistent, and upon completion of the separation, the stacking unit is moved to a position from which the medium can be fed in a case where the replacement of the medium is detected at the medium replacement detection unit; and wherein in a case where the medium replacement detection unit does not detect that the medium is replaced, or in a case where there is no instruction from the user, the state in which the feeding unit is separated from the medium is maintained.

2. The printing apparatus according to claim 1, wherein the moving unit separates the feed unit and the recording medium from one another, where the first information relating to a size of the recording medium, is inconsistent with the second input information relating to a size of the recording medium.

3. The printing apparatus according to claim 1, wherein the moving unit separates the feed unit and the recording medium from one another, where the first information relating to a type of the recording medium, is inconsistent with the second input information relating to a type of the recording medium.

4. The printing apparatus according to claim 1, wherein the moving unit renders one of the feed unit and the recording medium to contact the other of the feed unit and the recording medium, where the recording medium is detected as being replaced upon separation of the feed unit and the recording medium.

5. The printing apparatus according to claim 1, wherein the moving unit renders one of the feed unit and the recording medium to contact the other of the feed unit and the recording medium, where an instruction to continue printing is given upon separation of the feed unit and the recording medium.

6. The printing apparatus according to claim 1 further comprising a recording medium detection unit for detecting whether the recording medium is stacked on the stacking unit and a recording medium position detection unit for detecting whether the recording medium stacked on the stacking unit is located at a position from which a paper supply unit can feed the recording medium, wherein the recording medium position detection unit detects whether the recording medium is located at the position from which the paper supply unit can feed the recording medium after the recording medium detection unit detects that the recording medium is stacked on the stacking unit.

7. The printing apparatus according to claim 1 further comprising a memory unit for storing the second input information relating to the recording medium.

8. The printing apparatus according to claim 1, further comprising:

a paper position detection sensor arranged on a side of the feed unit; and a paper sensor arranged under the feed unit and the paper position detection sensor, wherein the paper position detection sensor detects the recording medium stacked on the stacking unit when the stacking unit is moved upward toward the feed unit by operation of the moving unit, wherein the paper sensor detects the recording medium stacked on the stacking unit when the stacking unit is moved downward to be further away from the feed unit by the operation of the moving unit, and wherein the moving unit moves the stacking unit upward upon the paper sensor detecting that the recording medium is replaced after the stacking unit is moved downward where the image information relating to the recording medium and the input information relating to the recording medium are compared with each other and deemed inconsistent.

9. The printing apparatus according to claim 1, further comprising:

a paper position detection sensor arranged on a side of the feed unit; and a paper sensor arranged under the feed unit and the paper position detection sensor, wherein the paper position detection sensor detects the recording medium stacked on the stacking unit when the stacking unit is moved upward toward the feed unit by the operation of the moving unit, wherein the paper sensor detects the recording medium stacked on the stacking unit when the stacking unit is moved downward to be further away from the feed unit by the operation of the moving unit, and wherein the moving unit moves the stacking unit upward upon the paper sensor detecting that the recording medium is replaced after the stacking unit is moved downward where the image information relating to the recording medium and information relating to the recording medium stored in a memory unit are deemed inconsistent.

10. The printing apparatus according to claim 1, further comprising a recording medium detection unit for detecting whether the recording medium is stacked on the stacking unit and being configured to move the stacking unit and the feed unit to be further from one another, from the close position, if the recording medium detection unit detects that the recording medium is not stacked on the stacking unit.

11. The printing apparatus according to claim 1, wherein the control unit further causes a notification of the inconsistency to be displayed by the printing apparatus concurrently with actuating the moving unit move the stacking unit relative to the feed unit to be further from one another when the second input information is deemed inconsistent with the first information.

12. A printing apparatus comprising:

a receiver unit for receiving, from an information processing apparatus, image information including image data and information relating to a size of a recording medium on which the image data is to be printed;

a detection unit for detecting the size of the recording medium;

a memory unit for storing the size of the recording medium detected by the detection unit as information relating to the detected size of the recording medium, and for storing first information relating to the recording medium after the first information relating to the recording medium to be stacked on the stacking unit is set;

a stacking unit for stacking the recording medium;

a feed unit for feeding a contacted recording medium into an interior of the printing apparatus by contacting the recording medium stacked on the stacking unit;

a moving unit for moving the stacking unit: in a direction to separate the feed unit and the recording medium from one another, or in a direction to render one of the feed unit and the recording medium, to contact with the other of the feed unit and the recording medium; and a control unit for actuating the moving unit to move the stacking unit relative to the feed unit to a close position after the information relating to the detected size of the recording medium is stored in the memory unit, if the recording medium is stacked on the stacking unit, and for actuating the moving unit to move the stacking unit relative to the feed unit to be further from one another, from the close position, after the image information relating to the recording medium and the information relating to the detected size of the recording medium are compared with each other and deemed inconsistent;

a notification unit for notifying that the image information relating to the recording medium is inconsistent with the information relating to the detected size of the recording medium in a case where the image information relating to the recording medium and the information relating to the detected size of the recording medium are deemed inconsistent; and a medium replacement detection unit for detecting whether the recording medium on the stacking unit is replaced;

wherein the control unit lets the notification unit notify that the image information relating to the recording medium is inconsistent with the information relating to the detected size of the recording medium and separates the feed unit from the medium in a case where the image information relating to the recording medium is inconsistent with the information relating to the detected size of the recording medium, and upon completion of the separation, the stacking unit is moved to a position from which the medium can be fed in a case where the replacement of the medium is detected at the medium replacement detection unit; and wherein in a case where the medium replacement detection unit does not detect that the medium is replaced, or in a case where there is no instruction from the user, the state in which the feeding unit is separated from the medium is maintained.

13. The printing apparatus according to claim 12, further comprising a recording medium detection unit for detecting whether the recording medium is stacked on the stacking unit and being configured to move the stacking unit and the feed unit to be further from one another, from the close position, if the recording medium detection unit detects that the recording medium is not stacked on the stacking unit.

* * * * *